United States Patent [19]

Takekida

[11] Patent Number: 4,493,550

[45] Date of Patent: Jan. 15, 1985

[54] DEVELOPMENT APPARATUS OF LATENT ELECTROSTATIC IMAGES

[75] Inventor: Yoshisuke Takekida, Tokyo, Japan

[73] Assignee: NEC Corporation, Tokyo, Japan

[21] Appl. No.: 482,647

[22] Filed: Apr. 6, 1983

[30] Foreign Application Priority Data

Apr. 6, 1982 [JP] Japan ..... 57-56992
Apr. 8, 1982 [JP] Japan ..... 57-58595
Apr. 8, 1982 [JP] Japan ..... 57-58596

[51] Int. Cl.[3] ..... G03G 15/10

[52] U.S. Cl. ..... 355/10; 355/14 D; 430/119; 118/650

[58] Field of Search ..... 355/10, 3 R, 3 DD, 14 D; 430/117, 118, 119; 118/661, 650

[56] References Cited

U.S. PATENT DOCUMENTS 3,232,190 2/1966 Willmott ..... 355/3 DD
3,980,404 9/1976 Townsend ..... 355/10
3,991,711 11/1976 Nakano et al. ..... 355/10 X
3,993,020 11/1976 Schneider et al. ..... 355/10 X
4,023,967 5/1977 McGibbon ..... 355/10 X
4,024,838 5/1977 Horie ..... 355/10 X

*Primary Examiner*—A. C. Prescott
*Attorney, Agent, or Firm*—Sughrue, Mion, Zinn, Macpeak, and Seas

[57] ABSTRACT

An electrostatic recording system having a drum 1 carrying a positively charged latent image 14, and a negatively charged cylindrical sleeve 10 having depressions 10*a* or other ink holding means on its outer surface. The sleeve is rotated into a tank 11 holding an electrically conducting ink 12 which is picked up in the depressions. The sleeve and drum are counter-rotating at different velocities and approach a narrow gap at which point the negatively charged ink is attracted to the positively charged image. Thereafter the inked image is transferred to a sheet of paper and the drum is cleaned and discharged.

8 Claims, 10 Drawing Figures

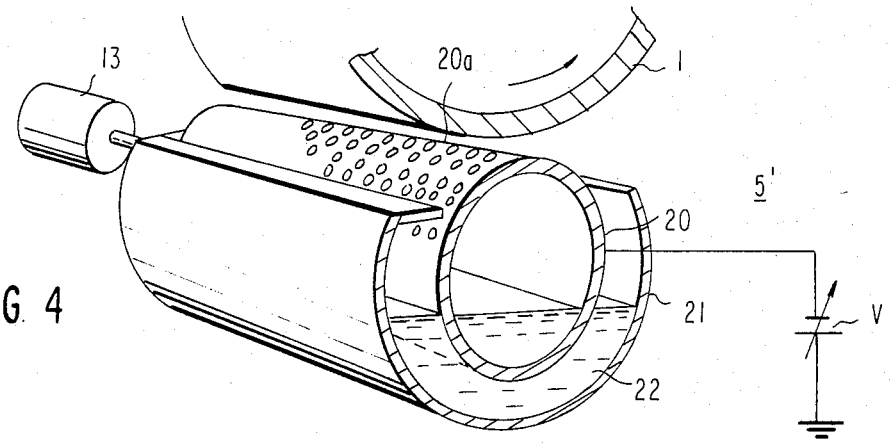
FIG. 4
FIG. 5(a)
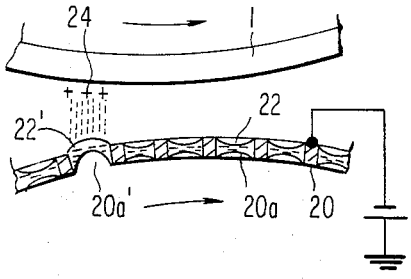
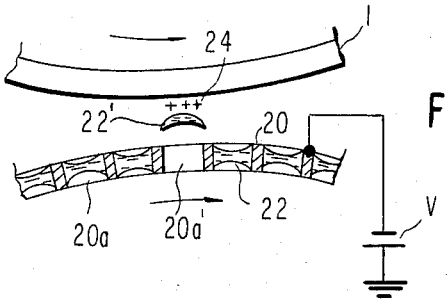
FIG. 5(b)
FIG. 6
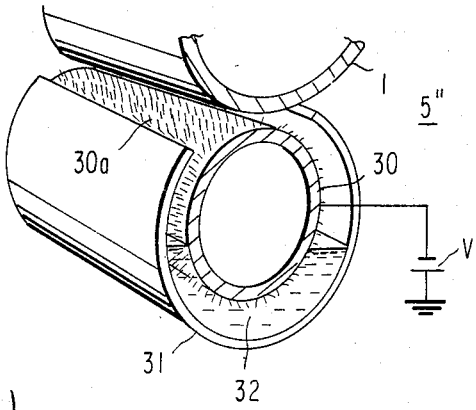
FIG. 7(a)
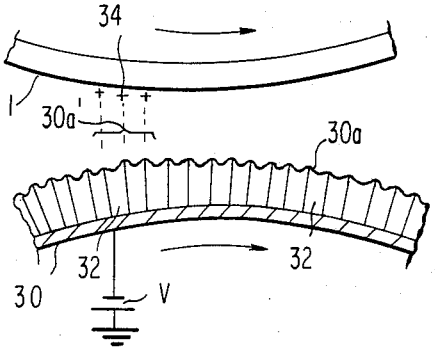
FIG. 7(b)
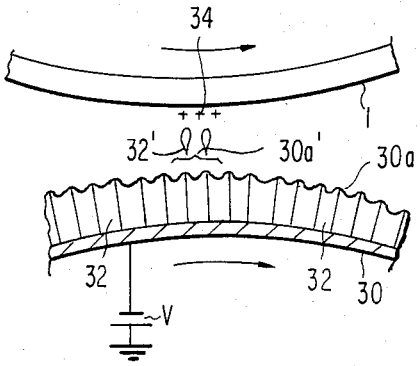

DEVELOPMENT APPARATUS OF LATENT ELECTROSTATIC IMAGES

BACKGROUND OF THE INVENTION

The present invention relates to an electrostatic recording system, and more particularly to a development apparatus for developing a latent electrostatic image formed on a photo-sensitive drum into a visual image by making a developer agent adhere to the latent electrostatic image.

The apparatuses for developing a latent electrostatic image on a photo-sensitive drum in an electrostatic recording system or an electronic photographic system are generally grouped into two types. One is a dry type development apparatus and the other is a wet type development apparatus.

In the dry type development apparatus powder-state ink or toner is used for developing a latent electrostatic image. The dry type development apparatus is further classified into a two-constituent and a single-constituent development apparatus. In the two-constituent development apparatus, a constant proportion mixture of toner and carrier consisting of magnetic powder is used as a developer agent. The toner is charged by the carrier and made to adhere to the latent electrostatic image on the photo-sensitive drum. Since this development apparatus can provide a high quality visual image, it is most generally employed in a copying device, an electrostatic recording printer, or the like, and therefore, the apparatus has been technically well developed. However, the apparatus requires control means for maintaining a mixing proportion between the toner and the carrier always at a constant value, with the result that the structure of the development apparatus is complex. In addition, since the charging effect of the carrier gradually decreases, over long times it is necessary to replace the carrier periodically. On the other hand, in the single-constituent development apparatus, only the toner is used as a developer agent, and hence there is no need to pay special attention to the mixing proportion control and the periodical replacement of a developer agent. However, in the latter apparatus, a high quality visual image has not to date been obtained, and further the kinds of paper sheets onto which the image is to be transferred were also limited.

On the other hand, an electrostatic recording system employing the wet type development apparatus can provide a high quality visual image. However, since an isoper solution which is a petroleum series solution is employed, careful attention must be paid to its handling and it is necessary to fully ventilate the room in which the system is located. Furthermore, according to this system, it is difficult to obtain a high density developed image, and available paper sheets are limited to only those having a good absorption capability.

In order to overcome the disadvantages of the above-mentioned development apparatuses in the prior art, a wet type development method employing a water-soluble developer agent or an organic liquid developer agent has been proposed in U.S. Pat. No. 4,202,913. According to the proposed development process, a drum of photo-sensitive material and a developer roller submerged in an ink tank are disposed in an opposed close relation without making contact with each other. The ink is formed in a film state on a surface of the developer roller by rotating it. Development is effected such that the electric charge of the latent electrostatic image on the drum attracts the film ink onto the surface of the roller while rotating the drum and the roller in the opposite directions to each other. The liquid developer located in the ink tank is carried up to the development zone in a process dependent upon the liquid developer's viscosity, surface tension and affinity with the developer roller surface. Consequently, it is difficult to maintain uniform thickness of the liquid developer in the development zone on the developer roller surface. Accordingly, the amount of the liquid developer attracted by the electric charge of the latent electrostatic image formed on the drum surface varies depending upon the film thickness of the liquid developer in the development zone, and consequently the latent electrostatic image cannot be developed uniformly and unevenness of development occurs.

Furthermore, the amount of the liquid developer attracted and separated from the developer roller surface does not exactly correlate to the electric attractive force of the latent electrostatic image due to the viscosity, surface tension, etc. of the liquid developer. In other words, sometimes development of the latent electrostatic image will be partially missing, or the liquid developer also adheres onto areas extending beyond that of the latent electrostatic image. Accordingly, a latent electrostatic image can not be developed precisely, and as a result, it is impossible to enhance the resolution of an printed image.

SUMMARY OF THE INVENTION

It is, therefore, an object of the present invention to provide a development apparatus in which a latent electrostatic image formed on a photo-sensitive drum can be developed into a uniform visual image of a high resolution by use of an electrically conductive liquid developer.

According to the present invention, there is provided a development apparatus, in which an electrically conductive sleeve or hollow roll, which is provided with micro-sized ink holding means on its outer circumferential surface, is disposed in an ink tank for accommodating an electrically conductive liquid developer, said sleeve being arranged in an opposed relation to a photo-sensitive drum without making contact with each other. A latent electrostatic image on the photo-sensitive drum is developed by rotating the drum and the sleeve in opposite directions with the drum and sleeve having a relative circumferential velocity.

BRIEF DESCRIPTION OF THE DRAWINGS

The above-mentioned and other objects, features and advantages of the present invention will be better understood from the following detailed description of preferred embodiments of the present invention taken in conjunction with the accompanying drawings, wherein:

FIG. 4 is a cross-sectional perspective view of a development apparatus used in a second embodiment of the present invention;

FIGS. 5(*a*) and 5(*b*) are enlarged cross sectional views of the development zone in the development apparatus shown in FIG. 4;

FIG. 6 is a cross-sectional perspective view of development apparatus used in a third embodiment of the present invention; and FIGS. 7(*a*) and 7(*b*) are enlarged cross-sectional views of the development zone in the development apparatus shown in FIG. 6.

DESCRIPTION OF THE PREFERRED EMBODIMENTS

Figure 1:
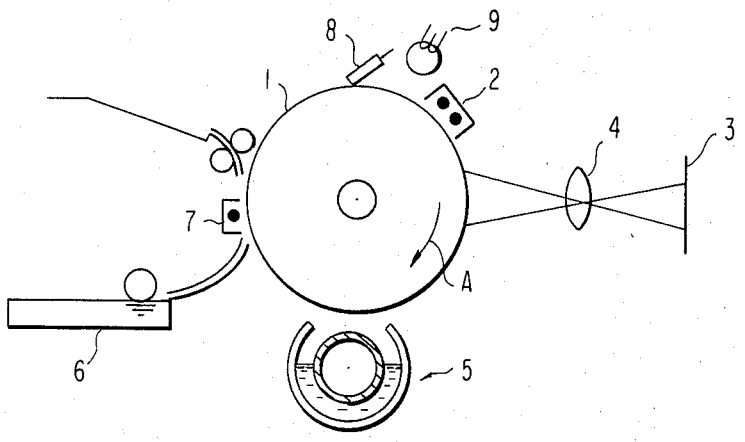
FIG. 1 is a schematic view showing an operation of an electrostatic recording system according to a first embodiment of the present invention.

Referring now to FIG. 1, around a photo-sensitive drum 1, a charging device 2, an exposure device 4, a development apparatus 5, a transfer device 7, cleaning means 8 and a charge remover 9 are disposed sequentially in the order of the electrostatic recording process. The surface of the drum 1 is coated with dielectric material by about 20 μm in thickness, and it is subjected to necessary treatments by the surrounding equipment while the drum 1 is rotated around its center axis in the direction of an arrow A. More particularly, at first, the surface of the photo-sensitive drum 1 is uniformly charged up to about 450 V by the charging device 2 which is a corona discharge generator. Subsequently, an image on an original sheet 3 is focused on the surface of the drum 1 by means of the exposure device 4 to remove the electric charge at light portions of the focused image on the surface of the drum 1. Thereby, a latent electrostatic image of positive electric charge is formed on the surface of the photo-sensitive drum 1. The developer agent is charged negatively in the development apparatus 5. The electrostatic image makes the developer agent adhere thereto by its electrostatic attractive force, and thus the latent electrostatic image is developed into a visual image. A sheet is fed to the transfer device 7 from a sheet hopper 6 by means of feed rollers. The transfer device 7 charges the fed sheet with a negative polarity. Therefore, the visual image formed on the drum surface is transferred to the sheet by the attractive force of the negative charge on the sheet. After the transfer, the remaining developer agent on the surface of the drum 1 is removed by the cleaning means 8. Finally, electric charge left on the drum surface is removed by the charge remover 9, and thus the electrostatic recording process is completed.

Figure 2:
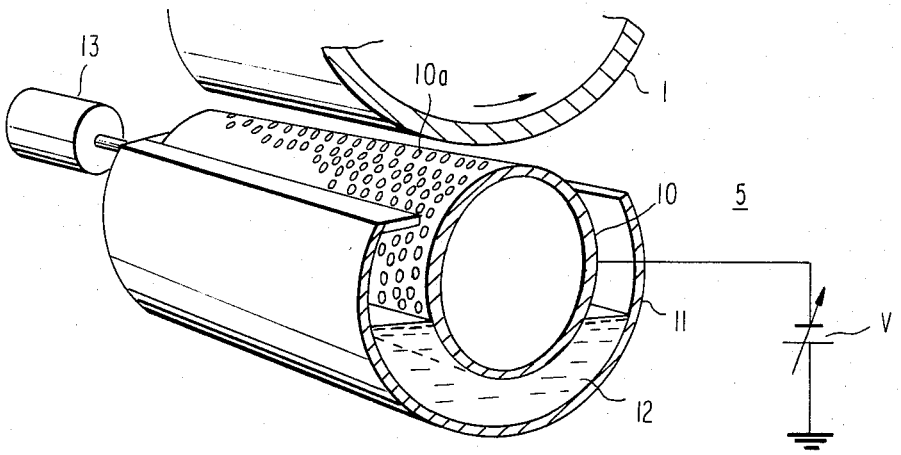
FIG. 2 is a cross-sectional perspective view of a development apparatus used in the first preferred embodiment shown in FIG. 1.

Referring to FIG. 2, the development apparatus 5 is mainly composed of an electrically conductive sleeve 10, an ink tank 11 and electrically conductive ink 12 filling the bottom of the tank 11. The electrically conductive sleeve 10 has a rotational axis parallel to a photo-sensitive drum 1 and rotates as driven by a motor 13. The sleeve 10 is placed close to the photo-sensitive drum 1 but without making contact therewith. The ink tank 11 is filled with electrically conductive ink 12 and the sleeve 10 is submerged in the ink 12.

The sleeve 10 has a hollow inner portion and a large number of minute circular depressions 10*a* formed on its surface. The sleeve 10 is a copper pipe formed with depressions on its surface by etching and is given a surface chromium plating thereafter. The depressions 10*a* are formed over the entire surface of the sleeve 10 and the density of formation thereof is 200 to 600 depressions per square inch. The depressions 10*a* are regularly arrayed in a zigzag matrix form, the diameter of a depression is 40 to 70 μm, the distance between the centers of the adjacent depressions 10*a* is 50 to 80 μm, and the depth of the depression 10*a* is about 10 to 50 μm.

It is to be noted that this sleeve having depressions could be also produced by coating with foamed (porous) aluminium on a surface of an aluminium pipe instead of etching a copper pipe.

A negative voltage V, preset at about −20 to −50 V, is applied to the sleeve 10, so that the ink trapped in the depression 10*a* by the rotation of the sleeve 10 is charged negatively. By making this voltage variable, printing density can be adjusted.

The photo-sensitive drum 1 and the sleeve 10 are disposed with their side surfaces opposed to each other. The gap distance therebetween at the closest position (development zone) is preset at about 0.3 to 0.5 mm. The photo-sensitive drum 1 and the sleeve 10 rotate in the opposite directions to each other, and a circumferential rotational velocities of the sleeve 10 is preset 3 to 7 times as high as that of the photo-sensitive drum 1.

In the development apparatus 5, a conductive liquid developer 12, having a viscosity of 5 to 7 cps, a surface tension of 3 to 4 dyne/cm and a specific resistivity of $10^8$ ohm-cm, is employed. These conditions are satisfied by the characteristics of water-soluble and oily ink which are generally and commercially obtained. Accordingly, the development apparatus 5 does not require a special liquid developer, and for instance, the ink for ink jet printer use or for fountain pen use can be utilized.

Figure 3A:
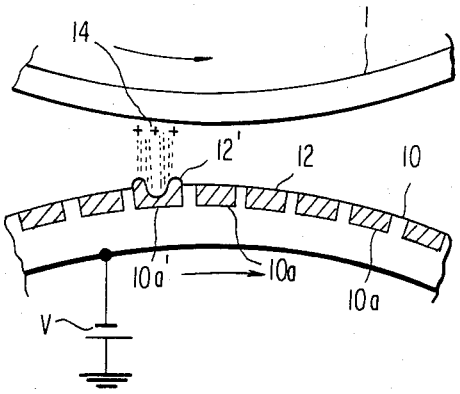
FIGS. 3(*a*) and 3(*b*) are enlarged cross-sectional views of the development zone in the development apparatus shown in FIG. 2.
Figure 3B:
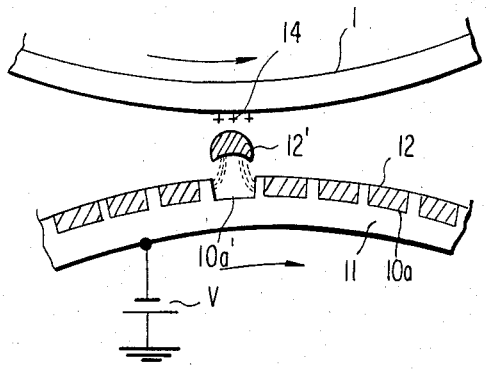

When the sleeve 10 arranged within the ink tank 11 is rotated by driving the motor 13, the liquid developer 12 is held within the large number of depressions 10*a* on the surface of the sleeve 10 and thereby carried to the position (development zone) opposite the photo-sensitive drum 1. As shown in FIG. 3 which partly shows the photo-sensitive drum 1 and the sleeve 10 at the development zone in an enlarged scale, the photo-sensitive drum 1 formed with a latent electrostatic image 14 on its surface and the sleeve 10 holding the liquid developer 12 in the depressions 10*a* are rotated in the opposite directions to each other at predetermined velocities. As shown in FIG. 3(*a*), the liquid developer 12 is held in the large number of depressions 10*a* and charged negatively. The latent electrostatic image 14 formed on the surface of the drum 1 is charged positively. As the latent electrostatic image 14 is gradually approaching the sleeve 10 by rotation of the drum 1, an electrostatic field between the latent electrostatic image 14 and the liquid developer 12′ held in the depression 10*a*′ which is opposed to the latent image 14 is increasing. Hence, an attractive force towards the photo-sensitive drum 1 is exerted upon the liquid developer 12′. As the drum 1 and the sleeve 10 further rotate, the distance between the latent image 14 and the liquid developer 12′ is further reduced and the attractive force exerted upon the liquid developer 12′ is further increased. When the distance between the drum 1 and the sleeve 10 is at a minimum, the attractive force exerted upon the liquid developer 12′ by the latent image 14 becomes maximum. As shown in FIG. 3(*b*), the liquid developer 12′ jumps up at this time in a droplet state towards the latent image 14, against its viscosity, surface tension and a gravitation, and adheres to the latent image 14 on the drum 1. In this way, the liquid developer 12 jumps up to the latent electrostatic image on the drum 1 in the droplet size defined by the depressions 10*a*, and thereby the latent image is developed into a visual image.

Since the developer liquid 12 can be reliably held up at the development zone by the depressions 10*a* on the surface of the sleeve 10, a uniform visual image can be formed on the drum 1. In addition, the depressions 10*a* are formed on the surface of the sleeve 10 at a high density, and the liquid developer 12 adheres to the latent electrostatic image on the surface of the drum 1 in the droplet state defined by the depressions 10*a*, so that the latent electrostatic image can be precisely developed into a visual image and the obtained visual image has a very high resolution.

Referring now to FIG. 4 showing a development apparatus 5' used in a second embodiment of the present invention, a cylindrical sleeve 20 is rotatably disposed within an ink tank 21. The sleeve 20 has a large number of micro-fine bores 20*a* regularly formed in its circumferential wall by a well-known process such as etching. The thickness of the cylindrical sleeve 20 is about 0.1 mm, the distance between the centers of the adjacent bores 20*a* is 50 to 80 μm, and the diameter of the bore 20*a* is 40 to 70 μm.

A negative voltage of about −20 to −50 V is applied to the sleeve 20, and thereby the electrically conductive liquid developer 22 held in the micro-fine bores 20*a* is charged negatively. A similar liquid developer 22 to that used in the first embodiment is used.

The gap between the photo-sensitive drum 1 and the sleeve 20, their rotational velocities and their directions of rotation are similar to those described above in connection to the first preferred embodiment, and therefore, further description thereof will be omitted.

Referring now to FIG. 5, the photo-sensitive drum 1 and the sleeve 20 are rotating in the opposite directions to each other in the development zone. As the latent image 24 on the drum 1 gradually approaches the sleeve 20, an attractive force towards the drum 1 is exerted upon the liquid developer 22' by the electric charge possessed by the latent image 24 (FIG. 5(*a*)). As the drum 1 and the sleeve 20 is further rotated, when the latent image 24 and the liquid developer 22' have approached up to the shortest separations, the liquid developer 22' held in the bore 20*a'* jumps up in a droplet state towards the drum 1 against its viscosity, surface tension and gravitation, and adheres to the latent image 24 (FIG. 5(*b*)).

The liquid developer 22 is carried to the development zone by being held in a large number of micro-fine bores 20*a* formed in the sleeve 20 and arrayed at a high density, and the liquid developer 22 develops the latent electrostatic image on the drum 1 into a visual image in the droplet size defined by the bores 20*a*. Therefore, a visual image of high quality and high resolution can be formed on the drum 1.

Referring now to FIG. 6 showing a development apparatus 5'' used in a third embodiment of the present invention, a large number of electrically conductive needle-like fine members 30*a* are studded around a cylindrical sleeve 30 made of stainless steel. The sleeve 30 rotates within an ink tank 31 to form a cylindrical brush. The length of the needle-like fine members 30*a* is 3 to 5 mm, and it is desirable to stud the members 30*a* as densely as possible. As a material for the needle-like fine members 30*a*, stainless steel or carbon fibers are used.

A negative voltage of about −20 to −50 V is applied to the sleeve 30, and thereby electrically conductive liquid developer 32 held around the needle-like fine members 30*a* is negatively charged.

The photo-sensitive drum 1 and the sleeve 30 are provided in an opposed relationship to each other, and the gap distance between the surface of the drum 1 and the tip end of the needle-like fine members 30*a* is appropriately about 0.3 to 1.5 mm.

The various conditions required for the liquid developer 32, and the rotational velocities and directions of rotation of the drum 1 and the sleeve 30 are similar to those described above in connection to the first preferred embodiment, and therefore, further description thereof will be omitted.

Referring to FIG. 7, in the development zone, the photo-sensitive drum 1 and the sleeve 30 are rotating in the opposite directions to each other with a certain relative circumferential velocity. As a latent electrostatic image 34 on the drum 1 gradually approaches the sleeve 30, an attractive force directed towards the drum 1 is exerted upon a developer liquid 32' held by the needle-like fine members 30*a'* due to the electric charge possessed by the latent image 34 (FIG. 7(*a*)). As the drum 1 and the sleeve 30 is further rotating, when the latent image 34 and the liquid developer 32' have approached up to the shortest distance, the liquid developer 32' held by the needle-like fine members 30*a'* jumps up in a droplet state towards the drum 1 against its viscosity, surface tension and gravitation, and adheres to the latent image 34. In this way a visual image can be formed on the drum 1 (FIG. 7(*b*)).

The developer liquid 32 is reliably carried to the development zone by holding the needle-like fine members 30*a* studded at a high density on the sleeve 30, and the latent electrostatic image on the drum 1 is developed into a visual image by the droplet liquid developer whose size is determined by the fine members 30*a*. Therefore, a visual image of high quality and high resolution can be obtained on the drum 1.

As described above, according to the present invention, a sleeve, having holding means for holding a micro-sized amount of the liquid developer on its outer circumferential surface, is disposed in an opposed relation to a photo-sensitive drum without making contact with it, and both the sleeve and the drum rotate having a relative circumferential velocity. Thereby, a latent electrostatic image formed on the surface of the photo-sensitive drum can be precisely developed at a high resolution, and as a result, an visual image of high quality can be transferred to a sheet.

What is claimed is:

1. A development apparatus of latent electrostatic images comprising, a drum of photosensitive material on which the latent electrostatic images are formed, a tank for accommodating an electrically conductive liquid developer, and an electrically conductive sleeve disposed rotatably within said tank and having a plurality of depressions formed and arrayed on its outer circumferential surface in a zig-zag matrix, said sleeve being disposed closely adjacent said photo-sensitive drum but spaced therefrom a predetermined distance.

2. The development apparatus as claimed in claim 1, further comprising means to apply a voltage of the opposite polarity to that of said latent electrostatic image to said electrically conductive sleeve.

3. The development apparatus as claimed in claim 2, wherein said voltage applying means applies a variable voltage.

4. The development apparatus as claimed in claim 1, wherein said depressions have a diameter of 40 to 70

μm, a depth of 10 to 50 μm, and a distance between centers of adjacent depressions of 50 to 70 μm.

5. The development apparatus as claimed in claim 1, wherein the gap distance between said photo-sensitive drum and said sleeve is arranged at 0.3 to 0.5 μm.

6. An electrostatic recording system comprising:

a photo-sensitive drum coated with dielectric material, on its surface, a charger for uniformly charging the surface of said photo-sensitive drum;

an exposure device for exposing the surface of said photo-sensitive drum in order to form a latent electrostatic image thereon;

a development apparatus including a tank for accommodating an electrically conductive liquid developer, and an electrically conductive sleeve disposed rotatably within said tank and having a plurality of depressions formed and arrayed on its outer circumferential surface in a zig-zag matrix for holding said liquid and disposed a predetermined distance from said photo-sensitive drum, whereby said latent electrostatic image can be developed into a visual image;

a transfer device for transferring said visual image formed on the surface of said photo-sensitive drum onto a sheet;

a cleaning device for removing liquid developer remaining on the surface of said photosensitive drum which has finished said transfer process; and a charge remover for removing electric charge remaining on the surface of said photo-sensitive drum which has finished said transfer process.

7. A development apparatus of latent electrostatic images comprising:

a photo-sensitive drum on which the latent electrostatic images are formed;

a tank for accommodating an electrically conductive liquid developer; and an electrically conductive sleeve disposed rotatably within said tank and having holding means for said liquid developer formed on its outer circumferential surface, said sleeve being disposed with a predetermined gap retained from said photo-sensitive drum, wherein said holding means is a plurality of bores provided in the outer circumferential wall of said sleeve penetrating through the wall.

8. A development apparatus of latent electrostatic images comprising:

a photo-sensitive drum on which the latent electrostatic images are formed a tank for accommodating an electrically conductive liquid developer; and an electrically conductive sleeve disposed rotatably within said tank and having holding means for said liquid developer formed on its outer circumferential surface, said sleeve being disposed with a predetermined gap retained from said photo-sensitive drum, wherein said holding means is a plurality of needle-like fine members studded on the outer circumferential surface of said sleeve.

* * * * *

UNITED STATES PATENT AND TRADEMARK OFFICE

CERTIFICATE OF CORRECTION

PATENT NO. : 4,493,550

DATED : January 15, 1985

INVENTOR(S) : Yoshisuke Takekida

It is certified that error appears in the above-identified patent and that said Letters Patent is hereby corrected as shown below:

Column 2, line 26, delete "can not" insert --cannot--.

Column 2, line 29, delete "an" insert --a--.

Column 6, line 47, delete "an" insert --a--.

Column 8, line 21, after "formed" insert --;--.

Signed and Sealed this

*Third* Day of *December 1985*

[SEAL]

*Attest:*

DONALD J. QUIGG

*Attesting Officer*

*Commissioner of Patents and Trademarks*